United States Patent [19]

Maier et al.

[11] 4,438,695

[45] Mar. 27, 1984

[54] CYLINDER FOR MACHINES PROCESSING RUNNING LENGTHS OF MATERIAL

[75] Inventors: Peter Maier, Worms; Arnold Niedermaier, Beindersheim, both of Fed. Rep. of Germany

[73] Assignee: Albert-Frankenthal AG, Frankenthal, Fed. Rep. of Germany

[21] Appl. No.: 519,891

[22] Filed: Aug. 3, 1983

Related U.S. Application Data

[63] Continuation of Ser. No. 292,782, Aug. 14, 1981, abandoned.

[30] Foreign Application Priority Data

Sep. 4, 1980 [DE] Fed. Rep. of Germany ..... 3033230
Apr. 11, 1981 [DE] Fed. Rep. of Germany ..... 3114731

[51] Int. Cl.[3] ..... B41F 9/06; B41F 13/18; B41F 13/20

[52] U.S. Cl. ..... 101/153; 101/375

[58] Field of Search ..... 101/152, 153, 216, 212, 101/219, 136, 141, 174, 375, 376; 29/116 AD, 116 R, 113 AD; 308/117, 20

[56] References Cited

U.S. PATENT DOCUMENTS

| | | | |
|---|---|---|---|
| 1,165,719 | 12/1915 | Sears | 308/117 |
| 1,364,647 | 1/1921 | Schwitzer | 308/117 |
| 1,408,602 | 3/1922 | Jontz | 308/117 |
| 1,633,806 | 6/1927 | Crawford | 308/117 |
| 3,161,125 | 12/1964 | Hornbostel | 29/115 X |
| 3,420,590 | 1/1969 | Bilocq | 308/20 X |
| 3,672,018 | 6/1972 | Junk et al. | 29/116 AD |
| 3,745,625 | 7/1973 | Jaegers et al. | 29/116 AD X |

FOREIGN PATENT DOCUMENTS

| | | | |
|---|---|---|---|
| 1292957 | 4/1969 | Fed. Rep. of Germany | 29/116 AD |

*Primary Examiner*—J. Reed Fisher
*Attorney, Agent, or Firm*—Allison C. Collard; Thomas M. Galgano

[57] ABSTRACT

A cylinder for machines processing running lengths of material is supported at its ends by bearing frames which may be moved for moving the cylinder, the cylinder having a pipe-like or tube-like outer casing which is supported by self-aligning bearings and has within it a core which is not turned and has an outer diameter smaller than the inner diameter of the casing, the casing being supported on the core by at least one support bearing which is symmetrical with respect to the middle of the casing and coaxial thereto. To give the casing a desired line of bending, to be in harmony with the cylinder with which it is used (on the other side of the running length of material) without being changed by moving the cylinder towards and away from the other cylinder, the pipe-like casing is supported in self-aligning bearings at its ends, separately from the core within it, on the end bearing frames. The ends of the core, running out from the pipe-like casing, are able to be moved by adjustment parts acting radially, such adjustment parts being supported on the two bearing frames. For prevention of any hot spots on the casing, the space between the casing and the core has an oil filling and on the core there are sloping blades for guiding oil towards the bearing or bearings by way of which the casing is supported on the core, this resulting in an even distribution of heated oil within the casing.

9 Claims, 5 Drawing Figures

CYLINDER FOR MACHINES PROCESSING RUNNING LENGTHS OF MATERIAL

This application is a continuation of Application Ser. No. 06/292,782, filed Aug. 14, 1981, now abandoned.

BACKGROUND OF THE INVENTION

The present invention is with respect to a cylinder for machines processing running lengths of material and, more specially to an impression cylinder for gravure printing presses or intaglio presses which, at its ends, is supported in an adjustable bearing frame and which has a pipe-like outer casing supported by self-aligning bearings at its ends, the casing having within it a core which is not turned and has an outer diameter smaller than the inner diameter of the casing, the casing being supported on the core by at least one support bearing which is coaxial to the casing and is symmetrical with respect to the middle of the casing.

GENERAL OUTLINE OF THE PRESENT INVENTION

One purpose of the present invention is that of taking care of the shortcomings of known systems.

A further purpose of the invention is that of designing a simple, low-price cylinder or impression cylinder of the sort noted which, on being moved up against and cleared from a cylinder (as for example the etched cylinder of a gravure printing press) will make contact with a line of bending or flexure of the casing which is not dependent on the putting of the cylinder into contact with the other cylinder and clearing it therefrom. A further purpose is that of designing such a cylinder which may be used under different conditions of operation, which is, generally speaking, quiet running and nevertheless is simple with respect to upkeep while, on the other hand, taking up little space and being generally strong.

This purpose and further purposes may be effected in a surprisingly simple way as part of the invention in that the pipe-like casing is supported in self-aligning bearings at its ends on the end frames in a way separate from the core within the casing and the ends, running out from the pipe-like casing, of the core are designed to be acted upon by separate adjustment parts working radially, such adjustment parts being supported on the bearing frames.

A cylinder designed on these lines may be forced against any opposite cylinder with a constant pressing force without being dependent on the geometry of the opposite cylinder so that a useful effect is produced. The necessary change in the line of flexure for producing an even line contact or pressure along the full breadth of the cylinder is, in this respect, simply produced by having a greater or lesser loading force on the casing, which is journalled separately from the core, by using the core, that is to say by using the adjustment parts at the sides of the system. Because the casing is separately supported in its bearings, the forces produced in this respect by the adjustment parts are handed over by the core, generally speaking, directly and without any levering effect (to obtain a greater force) on the middle part of the casing which is to be bent so that, with a good effect, generally low adjustment forces are needed for producing the desired line of bending. The adjustment parts are designed so that they may be worked separately from the change in position of the bearing frames, this being responsible for the useful effect that the line of bending of the casing may be kept even if the bearing frames are changed in position. Furthermore, when moving the cylinder towards the opposite cylinder and moving it clear thereof, a line of contact of the casing with the opposite cylinder is made certain of. Because, in this respect, it is not important for the core to be pre-loaded and it is only important that a force be transmitted by way of the core, the size of the cylinder may be very small in the length-direction. Furthermore, because the casing is separately journalled in the side bearing frames, there is, generally speaking, quiet and smooth running in all ranges of speed. Furthermore, in this case, the use of outside bearings placed on trunnions at the ends of the casing is possible, such bearings being readily accessible in case of need, that is to say so that upkeep may be very much simpler. A further useful effect produced by the invention is that, because of the fact that the casing bearings are directly supported by the side bearing frames, it is unlikely that there will be any offcenter running or wobbling at the ends of the casing.

As part of a further development of the general teachings of the invention, the adjustment parts used with the core take the form of rams, more specially hydraulic rams, whose operation pressure may be adjusted as needed. With such a system the adjustment of the forces produced by the adjustment parts may be readily remotely controlled and readily monitored. After the adjustment, the pressing acting on the adjustment parts may be kept at an unchanging level by locking the adjustment parts so that a line of bending of the casing which will be valid for a certain, given opposite cylinder, may be maintained without being changed on any adjustment of the positions of the bearing frames, until a change in the line of bending may be necessary.

A useful effect is produced if the ends of the core are supported in self-aligning or pivot bearings which, in each case, are supported in a bearing housing which is able to be moved in relation to the bearing frame next thereto, and which is joined up with the adjustment part in question. Such a design makes certain that the direction of force of the adjustment part is not changed by any bending of the core while, at the same time, making certain that there is no jamming. The rams forming the adjustment parts may have their cylinders or outer casings fixed to their bearing frames, while their piston rods are stiffly joined to the bearing housings. The piston rods, in this case, have the function of guiding the core so that, as a further useful effect, no separate guiding systems are necessary for the core.

As a more specially preferred form of the invention, the ring space between the core and the outer casing may be used for taking up a filling of oil, such an oil filling, however, not being complete. The support bearing or bearings are open towards the oil and to the side of each support bearing; there is at least one stripper which is not turned, such stripper having a blade running as far as a position near the inner face of the casing, and running along part of the inner casing in the circumferential direction at an acute angle to the direction of turning of the casing, while being further away from the side of the support bearing in the direction of turning. The oil filling in the ring-space, whose level may best be fixed by an overflow hole, will become coated over the inner face of the casing because of centrifugal forces, there then being an even distribution of the oil coating on the inside of the casing without any lopsided effects.

The stripper, which is not turned, makes certain that oil is forced towards the supporting bearing next to it all the time, this making certain of trouble-free bearing oiling. At the same time, a quick and trouble-free transmission of heat from the bearing to the oil is made certain of, and the oil, in the form of a coating on the inner side of the casing and which, moved by the stripper or strippers through the next support bearings, has the function of transmitting the heat, produced by the bearings, to the full cylinder casing. Putting it differently, when the bearings are heated, there is an even heating of all of the cylinder casing so that there will be no differences in thermal expansion at given points, which would be responsible for stresses. The heat is taken up evenly by the running length of material to be transported from the outer casing of the cylinder along the full length thereof.

A useful effect is produced if the stripper is made up of two blades, which are symmetrical with respect to the axis of the casing. This makes certain that on each of the two possible directions of turning of the outer casing, one blade takes effect. Such measures make upkeep of the cylinder very much simpler.

BRIEF DESCRIPTION OF THE DRAWINGS

Further useful developments and outgrowths of the general teachings of the invention to be seen from the account now to be given of two working examples to be seen in the figures, wherein.

DETAILED ACCOUNT OF WORKING EXAMPLES OF THE INVENTION

Figure 1:
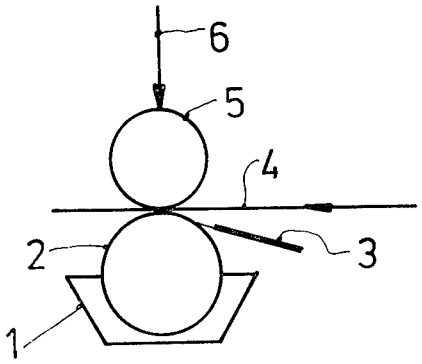
FIG. 1 is a diagrammatic side view of a gravure press.
Figure 2:
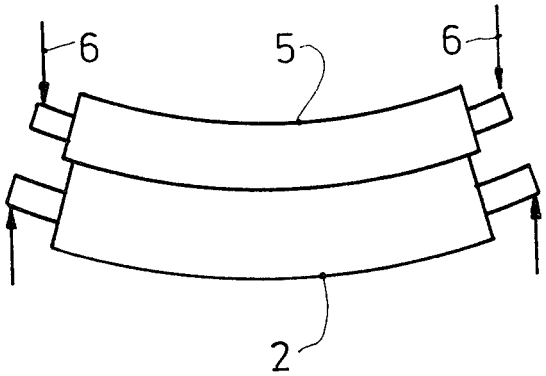
FIG. 2 is a view showing operation of two cylinders used together in the press, the figure not being true to scale in order to make clear the bending of the rolls.

The gravure press to be seen in FIG. 1 is made up in a known way of etched cylinder 2 running in an ink fountain 1 and acted upon by a doctor blade 3 and having the running length 4 of paper to be printed forced against it by an impression cylinder 5. Under the effect of this force as marked by arrow 6 and of its own weight, there will be a sagging of etched cylinder 2 as is made clear in FIG. 2 because of the larger scale used. For making certain of even line contact between the etched cylinder 2 and the impression cylinder 5 for the full length of the cylinders, it will be seen that it is necessary for the impression cylinder 5 to be bent to be in harmony with the line of bending of the etched cylinder 2, as will furthermore be seen in FIG. 2. Etched cylinder 2 is supported on the machine frame by bearings (not illustrated) so that it may readily be taken off and replaced by an other cylinder ready for operation, and is furthermore joined up with a driving system, unlike impression cylinder 5, which is simply turned by friction. For supporting impression cylinder 5 it will be seen from FIG. 3 that there are side bearing frames 7 which, in a way not to be detailed here, are guided by rails screwed onto the frame side walls for moving impression cylinder 5 towards and away from the etched cylinder 2, such motion being produced by adjustment rams 8 which are normally air-powered.

Figure 3:
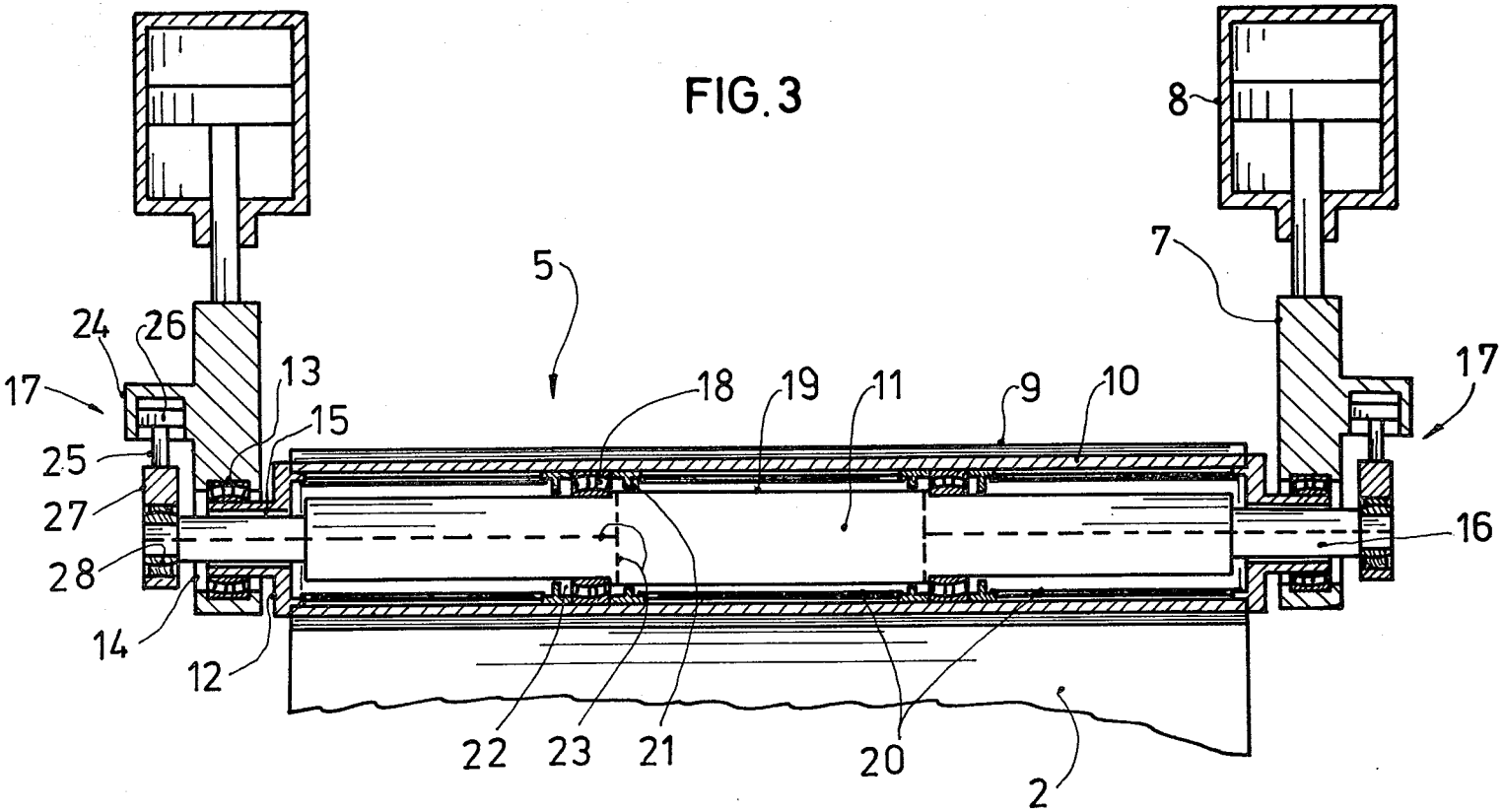
FIG. 3 is a view of an impression cylinder for a gravure press, partly in section.

The impression cylinder 5 of FIG. 3 is made up of a pipe-like outer casing 10 having a coating 9 of elastomeric material, and a core 11 running through the casing 10 with radial play. The core 11 is used for producing the sagged form to be seen in FIG. 2 by acting on outer casing 10 (having coating 9) which is used with the etched cylinder 1. Impression cylinder 5 may be so designed that core 11 is not turned on running the press.

Outer casing 10, running against etched cylinder 2, is journalled in the side bearing frames 7 so as to be separately supported from core 11. For this purpose, the pipe-like casing 10 has trunnions 12, flanged on its ends, such trunnions 12 being supported in self-aligning bearings 13, which are best designed as self-aligning rolling element bearings seated in bearing recesses 14 in the side bearing frames 7. The bearing support faces of the self-aligning bearings 13 placed on the trunnions 12 are, for this reason, readily accessible and, again for this reason, may be dressed somewhat if necessary, this making upkeep work on the system very much simpler. The flanged-on trunnions 12 have coaxial holes 15 to take up the ends 16 of the core 11 running through the outer casing 10 from end to end.

These ends 16, running out of the ends of outer casing 10, of core 11 are joined up with adjustment parts generally numbered 17, which, at their other ends, are fixed to or supported on the bearing frames 7 next thereto. Adjustment parts 17, which may be worked separately from adjustment rams 8, are designed for producing adjustment along a line in the direction of the likely sagging of the etched cylinder 2. The outer casing 10 having its coating 9 resting against etched cylinder 2 is supportingly joined up with at least one support bearing (of the sort marked at 18 in FIG. 3) placed symmetrically with respect to the middle of the outer casing and, for this reason, with respect to the middle of the press as well so that outer casing 10 may be supported by core 11 or acted upon by a supporting force thereby. The adjustment forces and the adjustment motion of adjustment parts 17, for this reason, take effect on outer casing 10 by way of core 11 and the support bearing or bearings 18. For this reason, outer casing 10 may completely abut along its full length the sagging etched cylinder 2. Support bearings 18, which are best designed as self-aligning rolling element bearings, make certain that sagging of core 11 is possible without any resistance. The radial play between core 11 and the pipe-like outer casing 10 is, it will be clear, to be made of such a size that a force or any sagging produced thereby of core 11 produced by adjustment parts 17, is not anywhere responsible for core 11 rubbing against sagging outer casing 10, such sagging of the casing taking place in the opposite direction under the effect of the forces acting by way of support bearings 18. Under working conditions, such sagging will, however, only be some millimeters in size. Because core 11 only has the function of being acted upon by forces coming from adjustment part 17 so that such forces may take effect on the outer casing 10 supported in the side bearing frames, it is, in itself, possible to have a single support bearing 18 placed at the middle of the press. In the present working example, two support bearings 18 are used spaced at equal distances (symmetrically) from the middle of the outer casing with a distance between them equal to about one third of the working length of outer casing 10. Having two separate support bearings makes certain, as a useful effect, that core 11, which is supported by way of adjustment parts 17 at its ends, is kept straight without any upward and downward motion of its ends in relation to the outer casing 10 supported in bearing frames 7, and so that it is not necessary for the two adjustment parts 17 connected to separate ends of core 11 to have to be kept in step or synchronized. The two support bearings 18 are each, on one side thereof kept in position by a thicker middle part 19 of core 11, and on their other sides by back-up tubes 20, whose other ends rest against the flanged-on trunnions 12 closing the ends of the pipe-like outer casing 10. At the ends of such back-up tubes 20 nearest bearings 18 there are keeper rings 21, each having a radial lip for closing oil spaces 22 next to support bearings 18 for the purpose of oiling support bearings 18 by way of radial and longitudinal holes 23 communicating with a central oil supply system. The oil makes its way back by way of holes in the core. The support bearings 18 are seated on core 11 with a stiff interference fit. For stopping the building up of dirt or rust by fretting or the like, core 11 may be provided with chrome at least at positions where the bearings are fixed on it so that support bearings 18 may be pulled off if desired. At their outer faces support bearings 18 may be seated in casing 10 with an interference fit as well or in the present working example with a sliding fit.

Adjustment parts 17 for acting on core 11 may be in the form of screwthreaded rods but, however, in the present working example, they are best in the form of hydraulic rams, made up of a ram casing 24 and a ram piston 26 having a piston rod 25. The hydraulic pressure acting on piston 26 may be changed as desired for adjustment by way of a valve, not shown. This pressure may therefore be changed till the force, acting on casing 10 by way of support bearings 18, gets to such a level that casing 10 abuts completely the full length of the etched cylinder 2 presently used in the press. After making an adjustment as may be necessary for the etched cylinder 2 presently in the press, the pressure acting on ram piston 26 is best kept at a fixed level and, for this purpose, the pressure spaces walled in by ram piston 26 may simply be hydraulically locked and/or joined up with an automatic hydraulic system making certain that a fixed level of hydraulic pressure is kept up even if there is a leak. The adjustment parts 17 for use with core 11 are worked separately from the adjustment rams 8 used for moving the side bearing frames. It is not necessary to keep the rams in step or synchronized. The change in position of core 11 as caused by adjustment parts 17 and the sagging or bending of casing 10 effected thereby are, for this reason, kept the same even if the impression cyliner 5 is cleared from the etched cylinder 2 by rams 8 so that, when impression cylinder 5 is moved up against etched cylinder 2 again, one may be certain that there will be the regular line contact produced earlier, and so that there is no snatching of the running length of paper causing tearing, when impression cylinder 5 is moved into position against etched cylinder 2 or cleared therefrom.

The adjustment parts 17 may be flanged onto the bearing frames next to them. In the present working example, the ram casing 24 is simply formed by having a shoulder on the side of bearing frame 7 in question so as to take up ram piston 26. Because of this stiff connection, the core 11 supported by adjustment parts 17 is guided, with good effect, by the ram pistons 26 themselves, which, in the present working example, are guided in the ram casing 24. Further guide parts are, for this reason, not needed, this being a further useful effect. The piston rods 25 fixedly joined to their ram pistons, in each case, have bearing eyes 27 in the form of a ring or the like, to take up one of the two core ends 16. In this respect, a self-aligning bearing 28 is used in the bearing eye so that, on sagging or bending of core 11, the ends of the core may be moved in relation to the bearing eyes 27 without any inner stresses. Because the core 11 is not rotated, self-aligning bearings 28 may be in the form of simple plain bearings which are crowned and covered with some bearing material having emergency running properties. However, it would be readily possible for piston rods 25 to be joined up directly with their different core ends by way of screwthreaded bolts having pivot or self-aligning bearings in their heads.

Figures 4, 5:
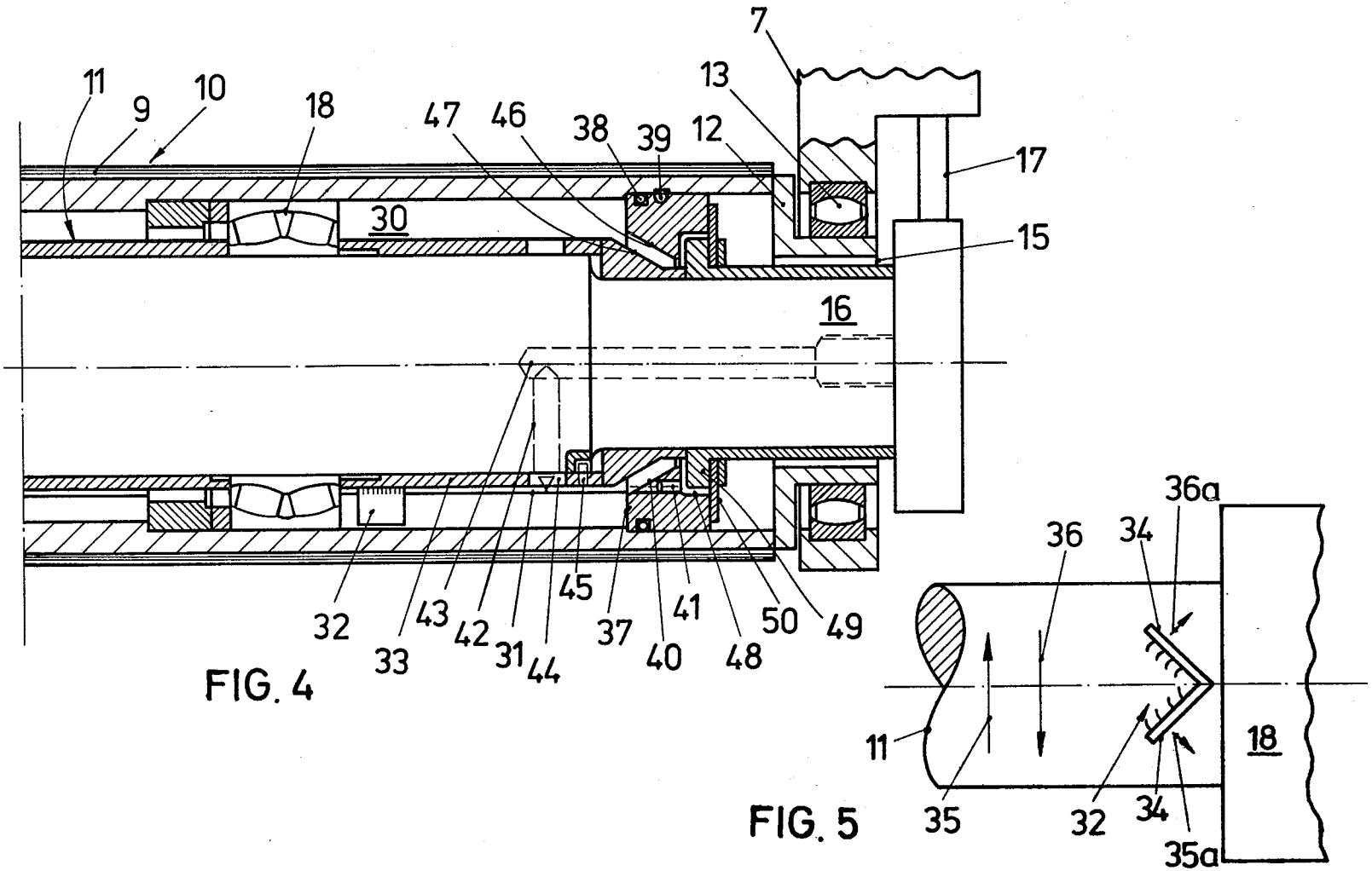
FIG. 4 is a view of an impression cylinder on the same lines charged with oil.
FIG. 5 is a plan view of the core of the impression cylinder of FIG. 4, having a stripper.

The general design of the further working example of the invention to be seen in FIGS. 4 and 5 is, in many respects, the same as that of FIG. 3. In the impression cylinder in the case of FIGS. 4 and 5, the ring space or annular space 30 between the casing 10 and the core 11 has an oil filling without being completely full of oil. The oil level, when the impression cylinder is not rotating, is marked at 31. On turning casing 10 on running the press, there is a distribution of the oil caused by centrifugal force evenly over the inner face of casing 10 so that the oil is not responsible for any lopsided running effect. The annular space 30 between casing 10 and core 11 is open towards support bearings 18 on the two sides thereof, so that such bearings are oiled by the oil filling. Furthermore, heat produced on running the bearings is conducted away from the bearings and there is an even distribution and loss of such heat over the full casing 10, the running length of paper being heated so that, putting it differently, the casing is in fact cooled by the paper. Because of this, there is only even thermal expansion, and furthermore the temperature is kept below an upper limit. Transmission oil with a low viscosity is best used for filling the casing 10.

For making certain of trouble-free input of oil to the support bearings, each bearing 18 has placed to the side of it at least one stripper 32, which is kept still, while casing 10 is rotated and is of such size in a radial direction that it comes to an end at a position near the rotatingly supported casing 10. Stripper 32 may be in the form of a sheet metal ear stretching along a short length of the inner face of the casing in the circumferential direction, the ear being placed at an angle so that, because of the rotation of the casing, oil moved past the stripper 32 will be pushed into the nearest support bearing 18 in the direction of the arrows 35*a*, 36*a* (see later, more detailed account) normal to the two flat parts of stripper 32, and into the support bearing 18 nearest to the stripper. For this purpose, the ear of sheet metal forming the stripper 32 is simply put at a slope at an acute angle to the direction of turning, and so as to be sloping away from the nearest support bearing 18.

The stripper 32, which is not turned with the casing 10, is best fixed to core 11 and in the working example shown, the stripper 32 is in fact welded to such core 11 or onto a sleeve 33 used for keeping support bearings 18 in position. It has become clear from experience that even one stripper on the outside of the sleeve is enough for producing the desired effect, but, however, it would be readily possible to have more than one stripper 32 and, in this case, the strippers would be evenly spaced round core 11. In the case of the working example of FIG. 4, the strippers 32, placed next to the support bearings 18 which are placed equally spaced from the middle of the casing, will be seen to be at positions on the sides of the bearings placing the ends of the impression cylinder, that is to say on the sides which are turned away from each other. It would, however, be possible in addition, or as a further possible design, to have one or more strippers 32 on the sides of the bearings turned towards the middle of the impression cylinder.

Stripper 32 is, as the reader will best be able to see from FIG. 5, made up of a sheet metal ear with two blades 34 placed at a right angle to each other, and of which each is so placed in relation to the direction of rotation of casing 10 that the direction of rotation may be changed without stopping the supply of oil to the support bearings 18. For each blade 34 of the stripper, the observations made earlier in the case of a single blade are true as well. In the case of the working example, the blade 34, placed over the axis of the core, of stripper 32 takes effect with the direction of rotating of casing 10 which would be in an upward direction (or in the direction of arrow 35) in FIG. 5. The lower blade 34 in FIG. 5 takes effect in the "downward" direction of turning (arrow 36) of casing 10. Lines normal to the blades marking the directions in which the oil is pushed for the two directions of turning of casing 10, are marked by arrows 35*a* and 36*a*.

The two-bladed stripper 32 may simply be made as a cut-off length of angle girder with a right angle between the two legs of the girder, one end of the cut off piece of girder being placed against the outer face of the core, so that the axis of the girder is radial with respect to core 11. In our present working example, the angle girder, forming the two-bladed stripper 32 is simply welded onto core 11. The end of the girder fixed on core 11, and the other end which is near the inner face of casing 10 of the length angle or L-girder are curved to be in line with the curve of the core 11, and of the casing 10 in the other case, so that, generally speaking, the ends of the piece of girder are parallel with the faces of core 11 and casing 10. Between the outer end of stripper 32 and the inner face of casing 10, it is best to have an amount of running play, best seen in FIG. 4, such that even when core 11 and casing 10 are bent to the greatest possible degree, the outer end of the stripper is still clear of the casing, and in actual experience it has in fact become clear that a running play of the order of 1 mm is all that is needed. It is best for the piece of angle girder, forming the two-bladed stripper 32, to be placed so that its corner is turned towards the support bearing 18 next to it, as will furthermore be seen from FIG. 5. This is to make certain that, with respect to the motion of the casing in relation to the stripper, the blade face turning away the moving oil is the outer face of the leg of the girder forming the blade in question, so that such turning effect on the oil current is not, in any way, stopped by the other blade.

The annular space 30 terminates at the end of the casing because of the presence of a radial wall or lip 37 having an outer gasket ring 38 running round it, so that there is an oil-tight joint between the outer edge of wall 37 and the inner face of casing 10. In our present working example, wall 37 is locked within the casing, for turning therewith, by way of a ball 39, taken up in a recess in the casing, and kept in position by way of a screw. The ring-like wall 37 has an eccentric hole 40 running in an axial direction and which is threaded that a screw 41 may be fixed in it. For filling up the impression cylinder with oil to the desired level, core 11 has a radial hole 42 opening into ring-space 30 and communicating at its inner end with a longitudinal, middle hole 43 in the core 11, running in from a female-threaded end part of hole 43 which may be communicated with an oil supply of some sort. Furthermore, the female thread here will be shut after filling by a threaded stopper. For a filling operation, screw 41 is taken out of hole 40 for use as an overflow and for letting off oil as soon as the oil gets to the desired level 31. Because the level of the oil is, when the impression cylinder is not running, much lower down than radial hole 43, there would, in fact, be no need to have a stopper in its outer end. The amount of oil placed in the ring space 30 may be used for a long time, and it is not a question of regular oiling being necessary. However, any losses of oil caused by leaks, which will in any case be present, are to be made good from time to time. The radial hole 42 is best near the end of the impression cylinder, it ending in ring space 30, so that hole 43 does not have to be made overly long in the axial direction. Sleeve 33 placed around core 11 has a cutout 44 lined up with radial hole 32. For keying sleeve 33 on core 11 a screw or a pin such as 45 may be used.

The inner edge of wall 37 is cone-shaped at 46 so as to become wider towards the middle of the impression cylinder with the result that, at a point near the level line 31, there is a slope running towards ring space 30 for automatically moving back oil into ring space 30. In the present working example the cone-shaped face at 46 is opposite to a parallel cone-shaped face at 47 on a part of sleeve 33 which is used for keeping the support bearing 18 in position. Sleeve 33 is, to make it simpler for the impression cylinder to be put together, made up of a number of lengths resting against each other at their ends. Ring wall 37 has at its end turned away from the cone-shaped face 46, a groove 48 running right around it and used for taking up a collar 49 on core 11 for forming a labyrinth, that is to say so that there is play between the collar and the face of groove 48. On collar 49 there is a radial cover 50 resting against the outer end face of ring wall 37 and, for this reason, shutting off the space between the core 11 and the ring wall 37 having the core 11 running through it. Cover 50 is best made of thin springy material so that it, in no way, has the effect of restraining a bending of the core 11 or of the casing 10. This free bending, which is desired, is naturally furthermore taken into account in making a decision about the size of the play between the outer edge of core 11 and the ring wall 37 placed around it.

The oil filled into the ring space 30, while the impression cylinder is not being turned, and which has its level at 31 so that it takes up part of the space 30, takes the form of an even layer of oil resting against the inner face of casing 10 when the impression cylinder is running. The strippers 32 placed for use with support bearings 18 have the effect of forcing the oil into their two bearings for oiling them. At the same time, the bearing and the oil are kept at the same temperature, heat being taken up by the oil from the bearing being then taken up by, generally speaking, the full casing 10 so that, in a way to be desired, even expansion is made certain of. The blades of the stripper 32 furthermore may be made curved.

We claim:

1. An impression cylinder for a printing machine having an impression and an etched cylinder, said impression cylinder including:

(a) a cylindrical outer casing supported at its ends on said machine by first adjustable support means including self-aligning bearings, (b) a cylindrical core coaxially disposed in said outer casing and supported therein by at least one support bearing disposed symmetrically with respect to the center of said outer casing, the ends of said cylindrical core extending beyond the ends of said outer casing, (c) second adjustable support means engaging the ends of said cylindrical core which are supported on said first support means for separate independent adjustment, said second adjustable support means permitting radial adjustment of said cylindrical core independent of said outer casing, (d) an annular oil receiving chamber defined between said cylindrical core and said cylindrical outer casing partially filled with oil, said chamber being open with respect to said support bearing supporting said cylindrical core within said outer casing, and (e) at least one strip-off device associated with each support bearing, supporting said core within said outer casing, disposed laterally therefrom and secured to said core extending radially toward said outer casing to strip the oil therefrom during operation and direct the oil toward said support bearing, said strip-off device including an angled segment disposed symmetrically with respect to the cylindrical outer casing axis, the apex thereof directed toward the associated support bearing, said angled segment being contoured to said outer casing and said cylindrical core.

2. The impression cylinder as defined in claim 1, wherein said at least one support bearing supporting said cylindrical core within said outer casing includes two separate support bearings seated on said cylindrical core with a stiff interference fit.

3. The impression cylinder as defined in claim 2, wherein said cylindrical outer casing has a predetermined length, and said support bearings supporting said cylindrical core thereon are placed at a distance apart equal to about one-third of the length of said casing, said support bearings being self-aligning rolling element bearings.

4. The impression cylinder as defined in claim 2, wherein said cylindrical core is chromed at said support bearings.

5. The impression cylinder as defined in claim 2, further including locking means for said second adjustable support means for locking said adjustable support means in a predetermined adjustment.

6. The impression cylinder as defined in claim 1, further including inlet means for passage of working fluid to said second adjustable support means so as to maintain said cylindrical core in an unchanging position.

7. The impression cylinder as defined in claim 1, wherein said second adjustable support means includes hydraulic motors.

8. The impression cylinder as defined in claim 1, further comprising hollow trunnions flanged on the ends of said outer casing, said self-aligning bearings for said outer casing supporting said trunnions in said first adjustable support means.

9. The impression cylinder as defined in claim 1, wherein said outer casing includes an overflow opening therein communicating with said annular oil receiving chamber controlling the level of oil filled in said chamber.

* * * * *